US005690515A

United States Patent [19]

Cipolla

[11] Patent Number: 5,690,515

[45] Date of Patent: Nov. 25, 1997

[54] SPLICING BLOCK FOR MULTI-STRAND ELECTRIC CABLE

[76] Inventor: Frank G. Cipolla, 8927 95th St., N., Seminole, Fla. 34647

[21] Appl. No.: 682,940

[22] Filed: Jul. 16, 1996

[51] Int. Cl.[6] ..... H01R 4/66

[52] U.S. Cl. ..... 439/797

[58] Field of Search ..... 439/797, 798, 439/100

[56] References Cited

U.S. PATENT DOCUMENTS

| | | |
|---|---|---|
| 2,201,674 | 5/1940 | Rowe et al. . |
| 2,210,750 | 8/1940 | Cook et al. . |
| 2,287,762 | 6/1942 | Rogoff . |
| 2,371,446 | 3/1945 | Jensen . |
| 2,499,985 | 3/1950 | Cafiero . |
| 3,015,084 | 12/1961 | Gribble . |
| 4,072,393 | 2/1978 | McDermott et al. . |
| 5,021,014 | 6/1991 | Walter et al. . |

*Primary Examiner*—Khiem Nguyen
*Assistant Examiner*—Eugene G. Byrd
*Attorney, Agent, or Firm*—Larson & Larson, P.A; James E. Larson

[57] ABSTRACT

A slicing block includes two threaded recesses, each of which intersects with a perpendicular passageway sized to require a multi-strand electric cable. A resilient saddle is guided vertically within each threaded recess by virtue of diametrically opposed vertical keyways formed through the threads of the threaded recess. A pressure screw is threadably received within each threaded recess and, when threaded into the threaded recess, engages a rear face of a saddle to reciprocate the saddle into the recess while being guided by the vertical keyways until the saddle bears upon an electric cable to clamp the electric cable into place within the perpendicular passageway.

11 Claims, 2 Drawing Sheets

SPLICING BLOCK FOR MULTI-STRAND ELECTRIC CABLE

BACKGROUND OF THE INVENTION

The present invention relates to a splicing block for multi-strand electric cable. In the prior art, clamping devices for clamping an electric cable within a recess are known. However, Applicant is unaware of any such device including all of the features and aspects of the present invention.

The following prior art is known to Applicant:

U.S. Pat. No. 2,201,674 to Rowe et al.

U.S. Pat. No. 2,210,750 to Cook et al.

U.S. Pat. No. 2,287,762 to Rogoff

U.S. Pat. No. 2,371,446 to Jensen

U.S. Pat. No. 2,499,985 to Cafiero

U.S. Pat. No. 3,015,084 to Gribble

U.S. Pat. No. 4,072,393 to McDermott et al.

The present invention is believed to patentably distinguish from these references since none of the references is believed to teach or suggest the use of keyways formed through the threads of a threaded recess to guide a saddle in movements toward and away from an electric cable inserted in a passageway perpendicular to the threaded recess.

SUMMARY OF THE INVENTION

The present invention relates to a splicing block for multi-strand electric cable. The present invention includes the following interrelated objects, aspects and features:

(1) In a first aspect, the present invention preferably consists of a rectangular cubic housing having means for splicing two electric cables. Each such means includes a threaded recess intersecting with a perpendicular electric cable receiving passageway.

(2) Each threaded recess has diametrically opposed vertical keyways cut through the recess threads and designed to guidingly receive a saddle having opposed protrusions, each of which is sized and configured to be slidably received within a respective such vertical keyway.

(3) Each threaded recess threadably receives a threaded pressure screw designed to engage a rear face of the saddle to reciprocate the saddle, as guided by the vertical keyways, into engagement with an electric cable received within the perpendicular passageway.

(4) The saddle includes a bottom surface that is arcuate in configuration and is designed to engage the arcuate surface configuration of the electric cable strands.

(5) The saddle includes a flat spring that is interposed between the pressure screw and the arcuate surface of the saddle with the spring imposing a biasing force upon the arcuate surface of the saddle to thereby facilitate clamping of the electric cable within the perpendicular passageway.

As such, it is a first object of the present invention to provide a splicing block for multi-strand electric cable.

It is a further object of the present invention to provide such a splicing block including two recesses, each of which is designed to receive an electric cable and corresponding pressure screws and saddles to clamp the electric cables within their respective passageways.

It is a yet further object of the present invention to provide such a device wherein each saddle is guided by vertical keyways formed through threads of a threaded recess designed to receive a respective pressure screw.

It is a still further object of the present invention to provide such a device wherein each saddle has a resilient component to interact with a respective pressure screw to facilitate imposition of constant spring biasing pressure on the conductor and thereby facilitate clamping of the conductor within a passageway.

These and other objects, aspects and features of the present invention will be better understood from the following detailed description of the preferred embodiment when read in conjunction with the appended drawing figures.

SPECIFIC DESCRIPTION OF TEE PREFERRED EMBODIMENT

Figure 1:
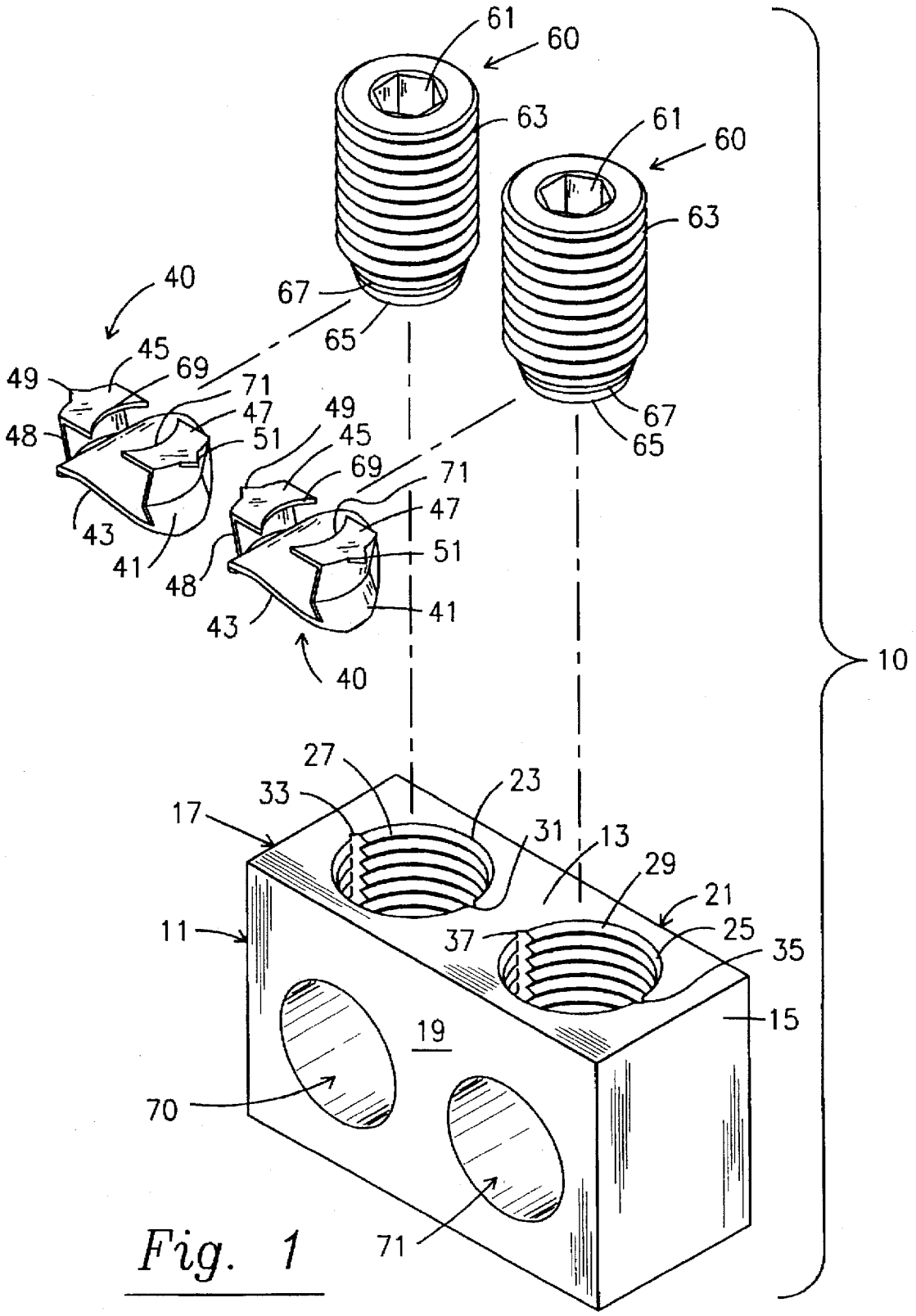
FIG. 1 shows an exploded perspective view of the present invention.

With reference, first, to FIG. 1, the inventive splicing block is generally designated by the reference numeral 10 and is seen to include a housing 11 of generally rectangular cubic configuration having a top surface 13, side surfaces 15 and 17, and front and rear surfaces 19 and 21, respectively. As seen in FIG. 1, extending into the housing 11 from the top surface 13 are two threaded recesses 23 and 25 with the threads being designated by the reference numerals 27 and 29, respectively.

Figure 2:
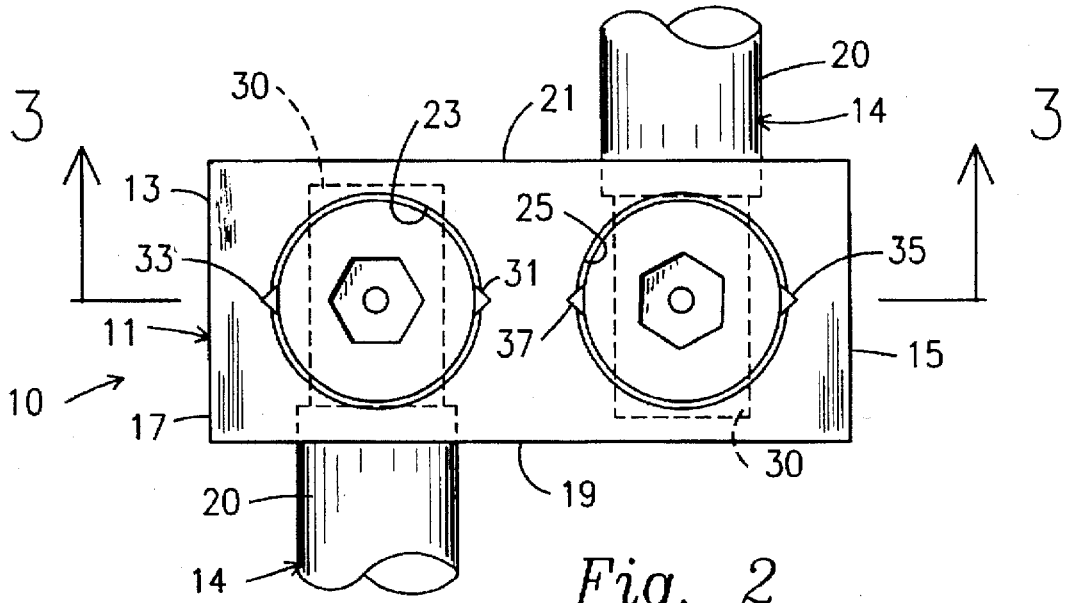
FIG. 2 shows a top view of the present invention with electric cables shown partially in phantom.

With particular reference to FIGS. 1 and 2, it is seen that the recess 23 includes diametrically opposed vertical keyways 31 and 33 that are cut through the threads 27 of the recess 23. Similarly, the recess 25 includes diametrically opposed vertical keyways 35 and 37 that are cut into the threads 29 of the recess 25.

Figure 3:
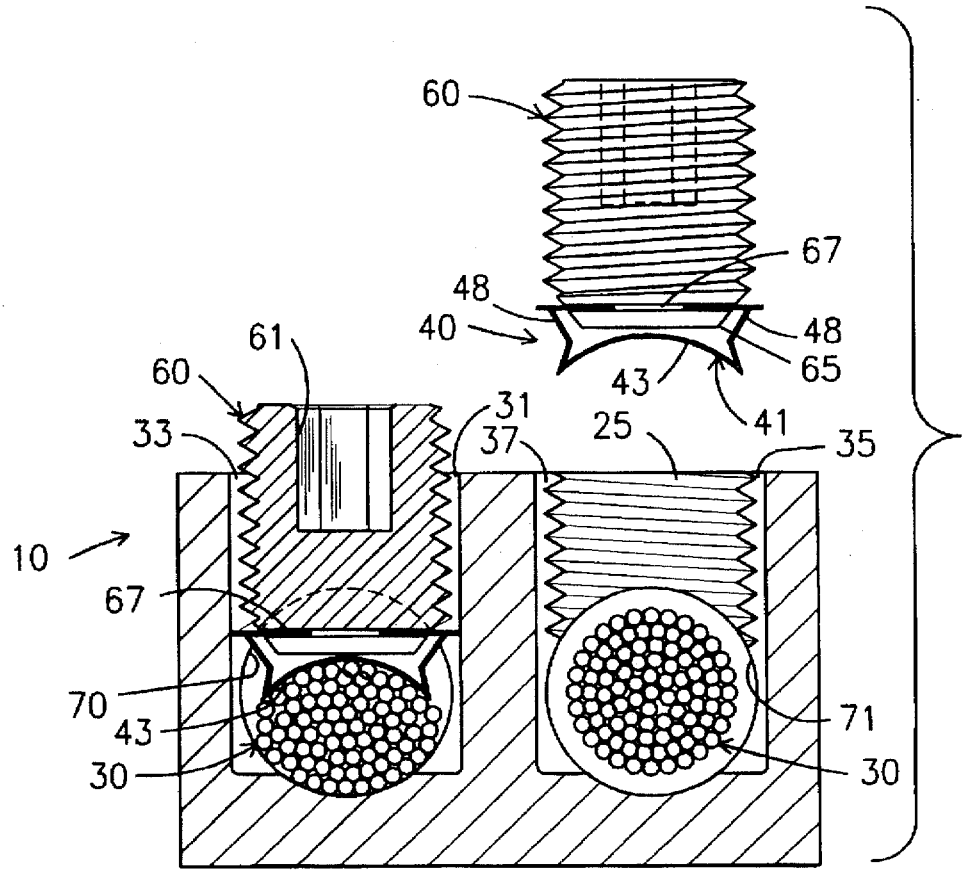
FIG. 3 shows a cross-sectional view along the line 3—3 of FIG. 2.

With reference, back, to FIG. 1, it is seen that two saddle mechanisms 40 are provided that are identical to one another. Each saddle 40 includes a pressure member 41 having an arcuate undersurface 43 that is best seen with reference to FIG. 3. With further reference to FIGS. 1 and 3, each saddle 40 includes two co-planar upper flat portions 45 and 47 with the portion 45 having a generally triangularly-shaped lateral protrusion 49 and with the flat portion 47 having a diametrically opposed triangularly-shaped protrusion 51. As should be understood from FIGS. 1–3, the protrusions 49 and 51 are sized and configured to be slidably received within the respective vertical keyways 33 and 31 or 37 and 35 of the threaded recesses 23 or 25 so that the saddle 40 may be guidingly received therein maintaining the position of the arcuate surface 43 thereof in a proper orientation to clamp an electric cable as seen in FIG. 3.

With reference to FIGS. 1 and 3, in particular, it is seen that each arcuate portion 43 is connected to the respective flat portions 45, 47 by generally V-shaped interconnection members 48 that are integral with the flat portions 45 and 47 to form a resilient biasing spring that resiliently transfers force from each pressure screw 60 onto a respective saddle under surface 43 and thence onto electric cable 14. Forces of 200 to 400 inch pounds over a movement of about 0.060 inches of travel can be achieved with the saddle engaged to screw 60 and pressing on cable 14.

With further reference to FIGS. 1–3, pressure screws 60 each include a tool receiving recess 61, a threaded exterior 63, with the threads thereof designed to enmesh with the threads 23 or 25, respectively, of one of the recesses 27 or 25, respectively. Each pressure screw 60 has an end 65 distal from the tool receiving recess 61 thereof that is generally conical in nature and screwed between the flat surfaces 45, 47 of the saddle 40 until recess 67 receives interior edge 69 of surface 45 and edge 71 of surface 47.

With reference to FIG. 2, two electric cables 14 are schematically shown and include a portion 20 having an insulated cover and a distal end 30 having the cover removed so that the multiple strands thereof are exposed as best seen with reference to reference numeral 30 in FIG. 3.

With further reference to FIGS. 1–3, it is seen that two passageways 70 and 71 are formed extending within the housing 11 from the front surface 19 thereof. If desired, these passageways 70, 71 may extend completely through the housing 11 or may comprise blind bores. If desired, the passageways 70 and 71 may be perpendicular to the respective threaded recesses 23, 25, or, if desired, may subtend any desired angle therebetween. When the passageways 70, 71 are perpendicular to the respective threaded recesses 23, 25, the clamping effect of the arcuate surfaces 43 of the respective saddles 40 is enhanced.

With the present invention having been described in detail, the manner of operation will now be explained. As should now be understood, electric cables 14 are provided and their ends are stripped of insulation to reveal the multi-strand conductor 30 thereof. Each such stripped end is inserted within a respective passageway 70 or 71. Thereafter, a saddle 40, with screw 60 attached by snapping the edges 68 and 71 into groove 67, is inserted within each threaded recess 23, 25. The pressure screw 60 and saddle 40 act as one unit until saddle 40 engages the keyways. The laterally extending protrusions 49, 51 of saddle 40 are received within the vertical keyways of a recess 23 or 25, including the keyways 33 and 31 of the recess 23 and the keyways 37 and 35 of the recess 25. Each saddle is guided within the vertical keyways of the respective recess 23 or 25 within which the saddle 40 has been inserted. With reference to the left-hand side of FIG. 3, it is seen that the arcuate surface 43 of the saddle 40 bears against some of the strands of the cable 30 whereupon rotation of the pressure screw 60 will cause reciprocation thereof to clamp the stripped end of the cable 14 within the passageway 70 or 71, as the case may be. Partial collapse of saddle 40 forms a peripheral force around the outside of the individual strands 30 of conductor 14 and bring them together in a tight bundle. As should be understood, in order to facilitate rotation of a pressure screw 60, a tool end is inserted within the tool receiving recess 61 of a pressure screw to facilitate such rotation and reciprocation. In the example shown in the drawing figures, the tool receiving recess 61 is of the kind designed to receive an "Allen" key. Of course, any desired tool receiving recess 61 may be employed.

The saddles 40 are preferably made of a material such as, for example, spring steel to facilitate the construction from one material including the integral portions that function as a spring as explained above.

A coating of a polymer can be applied to the housing 11 to provide additional insulating properties.

As such, an invention has been disclosed in terms of a preferred embodiment thereof which fulfills each and every one of the objects of the invention as set forth hereinabove and provides a new and useful splicing block for multi-strand electric cable of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A splicing block for an electric cable, comprising:

a) a housing having a passageway sized to receive an end of an electric cable;

b) said housing having a threaded recess extending from an outer face of said housing and intersecting with said passageway;

c) a vertical keyway formed through threads of said threaded recess;

d) a saddle receivable within said threaded recess and having a laterally extending protrusion receivable within said keyway;

e) a pressure screw threadably receivable within said threaded recess and capturing said saddle within said threaded recess;

f) whereby an end of an electric cable may be inserted into said passageway, said saddle may be received within said threaded recess and may be guided in linear non-rotative movement by interaction of said protrusion and keyway, said pressure screw being reciprocated to cause said saddle to clamp an electric cable within said passageway.

2. The splicing block of claim 1, wherein said end of said electric cable is stripped of insulation.

3. The splicing block of claim 1, wherein said threaded recess and passageway are perpendicular to one another.

4. The splicing block of claim 1, wherein said vertical keyway comprises a first vertical keyway, said recess having a second vertical keyway diametrically opposed to said first vertical keyway.

5. The splicing block of claim 4, wherein said laterally extending protrusion comprises a first protrusion, said saddle having a second diametrically opposed protrusion, each protrusion being guidingly received within a respective one of said keyways.

6. The splicing block of claim 1, further including a spring portion of said saddle to form a resilient biasing spring that receives a bottom portion of the pressure screw.

7. The splicing block of claim 1, wherein said saddle has an arcuate surface adapted to engage said cable.

8. The splicing block of claim 7, wherein said saddle includes an integral spring above said arcuate surface and engageable with said screw to provide a biasing force toward said arcuate surface.

9. The splicing block of claim 1, wherein said pressure screw has a top surface with a tool receiving recess extending inwardly therefrom.

10. The splicing block of claim 1, said housing further including a further passageway intersecting a further threaded recess.

11. A splicing block for an electric cable, comprising:

a) a housing having a passageway sized to receive an end of an electric cable;

b) said housing having a threaded recess extending from an outer face of said housing and intersecting perpendicularly with said passageway;

c) two diametrically opposed vertical keyways formed through threads of said threaded recess;

d) a resilient saddle receivable within said threaded recess and having two opposed laterally extending protrusions each receivable within respective ones of said keyways, said saddle having an arcuate surface adapted to engage an electric cable;

e) a pressure screw threadably receivable within said threaded recess and capturing said saddle within said threaded recess;

f) whereby an end of an electric cable can be inserted into said passageway, said saddle can be received within said threaded recess and can be guided in linear non-rotative movement by interaction of said protrusions and keyways, said pressure screw being reciprocated to engage said saddle to clamp an electric cable within said passageway.

* * * * *